US005359911A

United States Patent [19]

Kruesi

[11] Patent Number: 5,359,911

[45] Date of Patent: Nov. 1, 1994

[54] LIGHTWEIGHT SELF-INSULATING COMPOSITE TOOL

[75] Inventor: August H. Kruesi, Melrose, N.Y.

[73] Assignee: U.S. Composites Corp., Guilderland, N.Y.

[21] Appl. No.: 83,567

[22] Filed: Jun. 30, 1993

[51] Int. Cl.[5] ..... B25B 15/00

[52] U.S. Cl. ..... 81/436; 81/900; 81/489; 76/114

[58] Field of Search ..... 81/177.1, 436, 900, 81/489; 76/114, 119

[56] References Cited

U.S. PATENT DOCUMENTS

| | | | |
|---|---|---|---|
| 2,899,996 | 8/1959 | Stockman | 81/900 X |
| 4,729,271 | 3/1988 | Kenigson | 81/436 X |
| 4,858,504 | 8/1989 | Tsai | 81/436 |
| 5,259,277 | 11/1993 | Zurbuchen | 81/900 X |

*Primary Examiner*—James G. Smith
*Attorney, Agent, or Firm*—Sughrue, Mion, Zinn, Macpeak & Seas

[57] ABSTRACT

A lightweight self-insulating composite hand tool such as a screwdriver has a tool shank of electrically insulative material molded to and about a tip shank of a tool tip, having a working end and an integral tip shank. A mechanical interlock coupling is molded into the tip shank to resist axial tensile and compressive stress and torsional stress. A premolded replaceable elastomeric cover is slipped onto the hand tool and about the periphery of the molded tool shank. The working end of the tool tip includes a circumferential groove which receives a snap fitting bead of the replaceable elastomeric cover. The molded tool shank may be a braided composite of non-electrically conducting reinforcing filaments embedded within a settable matrix such as resin or epoxy. The tip shank is provided with an annular recess which flares rearwardly at a slight retention angle to retain the braided filaments and the settable matrix end of the composite tool shank on the tool tip shank. A molded core or mandrel having a conical front end is wedged into a conical bore within the tip shank, about which the filaments are wound in forming the braided composite tool shank. The periphery of the tool tip shank at the annular recess is provided with polygonal facets providing a mechanical interlock between the braided composite and the tool tip which resists axial tensile and compressive forces and torsional forces. A thermoplastic handle as adhesively fixed to the rear end of the braided composite tool shank.

27 Claims, 2 Drawing Sheets

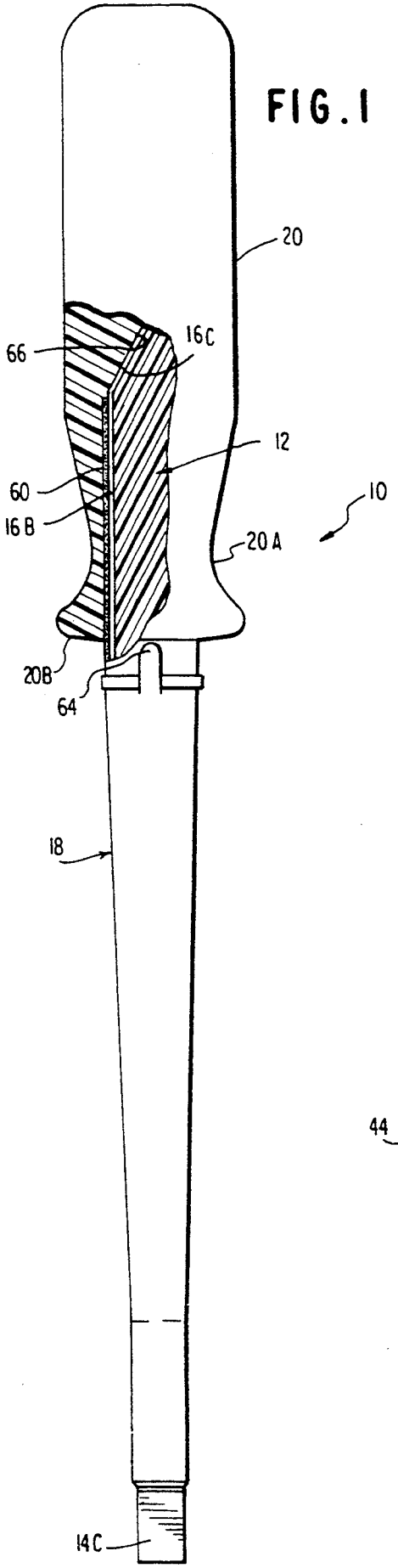
FIG. 1
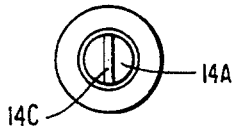
FIG. 2
FIG. 4
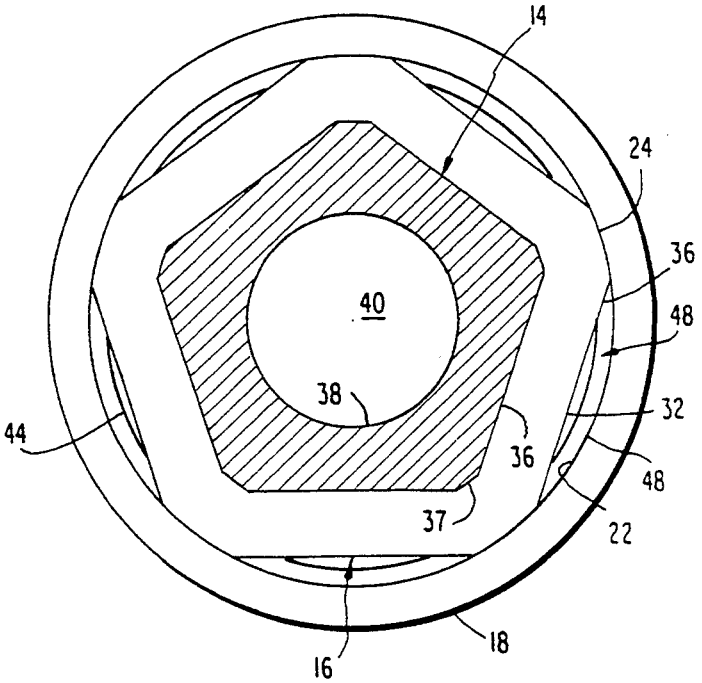

LIGHTWEIGHT SELF-INSULATING COMPOSITE TOOL

FIELD OF THE INVENTION

This invention relates to lightweight hand tools, and more particularly to a lightweight self-insulating composite tool shank of braided or wound form with enhanced coupling of the tool shank to a metal tool tip of generally circular geometry via a joint or coupling of high axial and torsional strength.

BACKGROUND OF THE INVENTION

Conscientious employers have always been concerned for the safety of their workers. In addition, as disability and medical costs have soared in recent years, employers can realize a major economic benefit by improving workplace safety. Workers in a variety of industries frequently experience muscular and skeletal injuries. For example, the Federal Occupational Safety and Health Administration has reported that spending for lower back injuries paid as Workers' Compensation, in medical and other direct costs, totaled 30 billion dollars in 1986. it was further reported that by the end of the century about fifty cents of every dollar paid as Workers' Compensation will go toward musculoskeletal injuries. Workers who must service equipment which may be electrically energized also face the constant risk of burns or even electrocution. Many of these accidents and injuries result directly or indirectly from the use of common hand tools in the workplace.

The safety coordinator of a major utility company reported that the tool packs of some of their linemen weighed as much as 70 lbs. The high incidence of muscular and skeletal injuries was directly attributed to excessive weight, especially for those workers involved in stressful environments such as outdoor work, climbing poles, etc. In addition, it was reported that insulated hand tools would provide a valuable measure of safety against the following high risk circumstances: one, the chance of electrical shock due to inadvertent contact with live electrical components; two, the possibility of flash-over between phases or phase to ground due to bridging of the live components or from live component to ground by the non-insulated part of the tool, such accidents resulting in risk of burns and eye injury to the user; three, the possibility that the user will inadequately insulate their own personal hand tools with electrical tape or heat shrink materials; and four, the risk of damage to electrical equipment caused by accidental contact of metal tools with energized components. It was further pointed out that since the primary side of transformers was not fused, an inadequately insulated tool dropped in the wrong location could result in massive damage to equipment and a dangerous environment for the worker.

In response to the need for safer hand tools for workers in the electrical fields, the International Electrotechnical Commission has developed a standard to cover hand tools for live working up to 1,000 volts AC and 1,500 volts DC (IEC 900). Hand tools currently available which conform to the standard are typically a traditional metal shank covered by one or two layers of a plastic insulation material. While this can provide an adequate level of protection against electrical hazards, the so called insulated tools are actually heavier and bulkier than standard hand tools. Furthermore, their long-term reliability is not assured due to the likelihood of cuts, wear, and contaminants becoming embedded in the surface of the insulating material. This presents a major difficulty to employers wishing to provide their workers with safer hand tools. Because of the vulnerability of the insulating material, it will be necessary to frequently inspect and retest the insulating capability of the tool. In practice, this may be virtually impossible due to the large proliferation of hand tools and the difficulties of keeping a log on each and every tool. Furthermore, since a cut which would ruin the insulating capability of the tool could occur at any moment, there is really no safe inspection interval that can ensure that the insulating properties will never be compromised. As stated earlier, the insulated hand tools will actually aggravate the problem of tool weight and ergonomics due to their increased weight and bulk, so the enhanced safety for electrical risks is being obtained at some expense of other safety aspects.

It is therefore an object of this invention to greatly enhance workplace safety by providing a practical, self-insulating hand tool, while also providing weight savings, which benefits all workers.

SUMMARY OF THE INVENTION

This invention provides a means of reducing the weight of common hand tools by up to 70%. This enables two safety objectives to be met. First, there will be a direct reduction in the likelihood of muscular and skeletal injuries due to the weight of workers' tool belts and pouches. Second, the lightweight tools of this invention renders an innovative style of tool holding system feasible which will facilitate handling of tools for workers in high risk situations such as standing on ladders, working atop utility poles, etc.

This invention further provides a superior level of safety against electrical hazards. In contrast to existing insulated tools, this invention provides common hand tools which can be made almost entirely of self-insulating materials. Only a small exposed portion at the working end of the tool need be made of a electrical conductive material such as metal. Therefore, almost the entire body of the tool and handle consists of all electrically insulating material. An additional safety feature of this invention is the use of a replaceable insulating cover. This cover provides a solution to two common hazards which limit the reliability of existing insulated tools. First, it has been noted by utility safety coordinators that in a high voltage environment, the insulating capability of the tool depends very much on the surface cleanliness and integrity of the tool. Since hand tools frequently become abraded, scraped, impacted, etc. in use, this invention provides to the user a structure permitting immediate renewing of the surface of the tool thereby assuring that a virgin surface is available at all times. Furthermore, by separating the functions of the insulating cover from the structural shank of the tool, it is possible to take advantage of the best characteristics of different materials. In other words, an optimally electrically insulating material may be used for the cover while an optimal structural material may be used for the shank or body of the tool which must transmit the force or torque to the tool tip.

As will be evident from the detailed disclosure which follows, this invention provides additional safety features, depending on the application such as low thermal conductivity (for safer cold weather work), non-sparking materials throughout, non-magnetic materials throughout, and optionally hollow cores for markets in which the weight savings are of greater importance than ultimate electrical insulating capabilities.

BRIEF DESCRIPTION OF THE DRAWINGS

FIG. 1 is an exploded view of a lightweight self-insulating composite shank screwdriver forming a preferred embodiment of the invention, partially broken away to illustrate the joint between the injection molded thermoplastic handle and the braided or wound structural composite tool shank.

FIG. 2 is an end view of a metal tool tip of the screwdriver of FIG. 1.

FIG. 4 is a transverse sectional view of the screwdriver of FIG. 3 taken about line 4—4.

DESCRIPTION OF THE PREFERRED EMBODIMENTS

Figure 3:
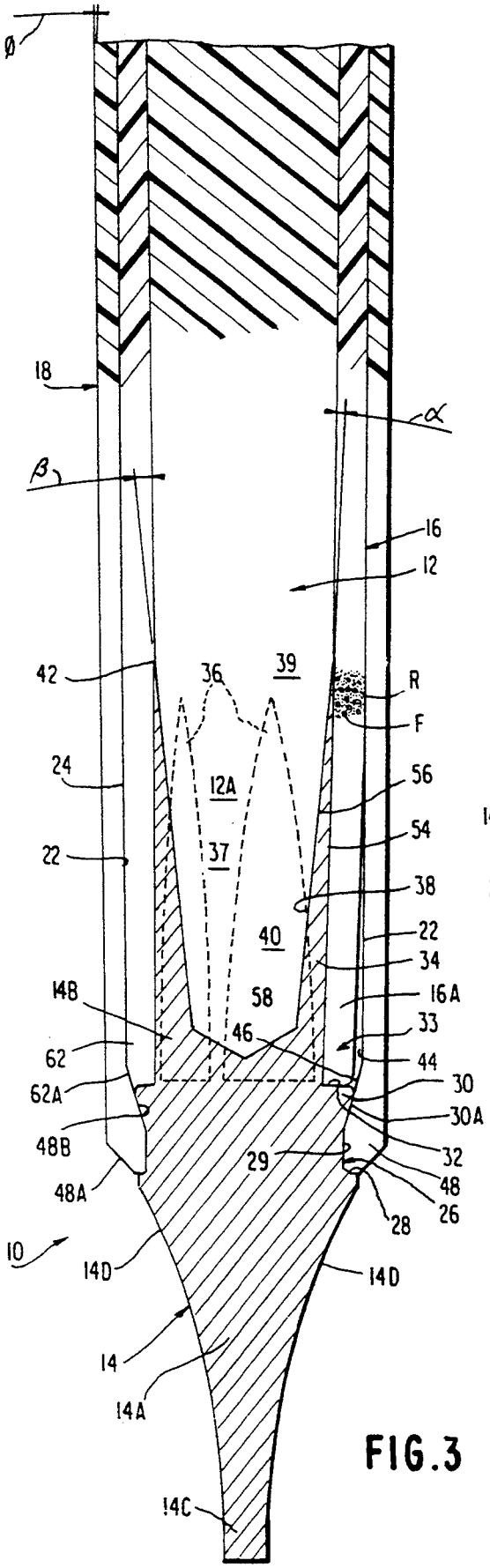
FIG. 3 is an enlarged, longitudinal sectional view of a portion of the braided or wound structural composite tool shank and the tool tip of the screwdriver of FIG. 1.

The key features of the present invention are illustrated by lightweight, self-insulating composite tool shanks incorporated within lightweight self-insulating screwdrivers, forming two practical embodiments of the invention. The hand tools, i.e., screwdrivers 10 and 10' of FIGS. 1 and 5, respectively, show the general structural content of the improved lightweight self-insulating hand tools, however the invention has application to hand tools other than screwdrivers such as nut-drivers, allen wrenches, Torx TM drivers, ratchet extensions, wrench handles, etc. Like numerals are employed for like elements with respect to the two embodiments illustrated in the drawings and described hereinafter.

Referring to FIGS. 1–3 inclusive, electrically insulating the hand tool or screwdriver 10 in a first embodiment is formed preferably of a symmetrical or asymmetrical braided composite shank 16 about an injection molded core or mandrel 12. The braided composite shank 16 is braided over a metal tool tip shank 14B of a metal tool tip 14. Separately molded, preferably by injection molding technique, is an elastomeric shank cover 18 of hollow tubular form, which may be axially slipped on and preferably stretched about the exterior of the braided structural composite tool shank 16. Further, an injection molded thermoplastic handle 20 covers the rear end of the mandrel 12. The composite shank 16 tapers with increased diameter from the shank front end 16A to a rear end 16B. The injection molded elastomeric shank cover 18 is preferably of uniform thickness, and provided with a conical bore 22 which matches the conical exterior surface 24 of the tool composite shank 16, but being of slightly smaller size so that the elastomeric shank cover 18 stretches slightly for a friction grip on the exterior surface 24 of the tool shank 16 when assembled as per FIGS. 2 and 3. Alternatively, the composite tool shank 16 of the first embodiment may be either symmetrically or asymmetrically braided of electrically insulating material filaments of fibers F embedded in a suitable resin R to form the composite structure, or the filaments may be wound on the tapered mandrel 12. As may be appreciated, the metal tool tip 14 has an external configuration, particularly in the area of the tool tip shank 14B so that the metal tool tip 14 is braided in or wound in prior to the setting of a settable resin R, maintaining the reinforcing fibers or filaments F in high strength engagement with the exterior surfaces of the tool tip shank 14B forming a high strength mechanical coupling resisting applied axial tensile and compression forces, and torsion forces tending to rotate the composite tool shank 16 relative to the metal tool tip 14 after winding or braiding of the reinforcing filaments F and the setting of the resin R (FIG. 3).

The tool tip 14 may be made of a variety of materials depending upon the nature of the hand tool and the application to which the hand tool is employed. For example, the tool tip may be formed of chrome-vanadium alloy steel; 17-4 PH Stainless Steel for corrosion resistant tools; Berylium-Copper for non-sparking tools, and Titanium-6AL-4V for ultralight weight tools. The metal employed in the manufacture of the tool tip 14 may be readily varied depending upon the need for strength, corrosion resistance, and lightweight aspects for the resulting hand tool. The metal tip 14 constitutes the high wear resistant element of the hand tool for transferring torque from the user's hand into a fastener or other object being worked on by the tool.

FIG. 3 illustrates the details of the metal tip 14 and its special features to improve the reliability and strength of the connection or attachment to the molded in composite shank 16. The metal tip is composed of two portions or sections, a front, working end 14A and a rear, metal tip shank 14B. The working end 14A flares into a flat, narrow screwdriver blade 14C, where the tool 10 takes the form of a screwdriver, while the tip shank 14B is of generally cylindrical form in the area of the junction between the working end 14A and the tip shank 14B. The working end 14A at the rear thereof is provided with a circumferential groove 26 defining an oblique shoulder 28, which circumferential groove constitutes a snap locking groove for a resilient bead 48 of the front end of the replaceable elastomeric cover 18. Bead 48 is constituted by a radially enlarged portion of the stretchable molded plastic cover 18, having a conical end face 48A, which merges with the outwardly flared, curved surface 14D of the metal tip working end 14A. The groove 26 includes a bottom 26A which is of constant diameter and terminates rearwardly in a conical, radially outwardly flared oblique wall 27 which defines a radially outwardly projecting conical flange 30. The conical surface 27 matches the conical surface 48B of bead 48 so as to facilitate the snap fitting of bead 48 into the circumferential groove 26. The conical flange 30 is partially formed by a radial shoulder 32 defined by an annular recess 33 within the tip shank 14B which extends from the conical flange 30, rearwardly, to trailing edge 42 of the metal tip 14. The annular recess 33 receives the leading end 16A of the composite tool shank 16, which is preferably formed by braiding reinforcing filaments F about the outer periphery 52 of mandrel 12 and the outer periphery 54 of the tip shank 14B at annular recess 33. In the preferred embodiment of FIG. 1, the annular recess 33 is not defined by a cylindrical exterior surface 54 of the tip shank 14B, rather surface 54 is at a conical and very shallow oblique angle. Surface 54 flares rearwardly and outwardly from shoulder 32 at a retention angle $\alpha$ of approximately 2°. The retention angle $\alpha$ creates a mechanical interlock of the metal tip shank 14B to the composite 16. Preferably, as will be seen in the embodiment of FIG. 4, there is provided a circumferential groove adjacent to working end 14A, which facilitates the deposition of fibers or filaments F during a braiding or winding process of reinforcing fibers which most often consist of multiple plies of such fibers or filaments F. The annular recess 33 constitutes a very shallow circumferential groove in the embodiment of FIGS. 1–3 to position the reversals of the braided or wound plies of reinforcement fibers or filaments F and to provide a push-pull capability in metal tip 14. With a 2° retention angle $\alpha$ the annular recess 33 is deeper near the front end of the tip shank 14B, a slope of 2° of the polygonal flat walls of the axial retention recess or groove 33 is selected to provide the required axial force capability, while still allowing for reasonable producability of the braided on or wound on filament reinforced resin impregnated and set composite structure at leading end 16A of that composite, where the reversals of the filaments F occur. Spaces at 44, FIG. 3, will fill with solid resin R which sets during curing.

The remainder of the metal tip 14 rearwardly of conical flange 30 consists of a plurality of circumferentially spaced facets 36, giving the cross section of the exterior surface 54 of the metal tip shank 14B a polygonal profile. As seen from FIG. 4, which is a cross section taken about line 4—4 of FIG. 3, the polygonal profile takes the form of a pentagon to provide positive transmission of torque via contact pressure. The polygon may range from three to eight sides, while effectively transmitting torsion forces from the handle 20 of the tool 10 to the screwdriver blade 14C of the working end 14A of the metal tip 14. In the illustrated embodiments five facets 36 are circumferentially spaced by each other by flats 37 and constitute a positive mechanical interlock coupling between the braided or wound composite reinforcement fibers or filaments F and the metal tip 14 to ensure transmittal of high torque forces to the tool metal tip 14.

Preferably, the tip shank 14B is hollow to provide a countersunk internal region 39 defined by a conical bore 38 which terminates in the vicinity of the radial shoulder 32 in a conical end wall 40. This internal region 39 reduces the weight of the metal tip and locates the metal tip 14 on the permanent or removable mandrel 12 having a shallow, conical peripheral portion 56, matching that of the conical bore 38 of the metal tip, and a conical end wall 58 matching that at 40 of the internal region 39. By positively locating the metal tip on the permanent or removable mandrel 12, the braiding or winding of the filaments or fibers F will be facilitated, while additionally preventing an abrupt change in the stiffness which would lead to a stress concentration and therefore premature failure at the composite to metal joint effected between composite tool shank 16 and metal tip 14. The metal tip 14 is thus integrally retained by the resin R impregnated braided or wound fiber F reinforcement. Typically the resin R is co-cured during the composite fabrication and molding process after resin R impregnation of the fibers F wound or braided. Braiding of resin carrying fibers F about the mandrel and the portion of the tip shank 14B carrying the annular recess or groove 33 may be effected. The result is a redundant axial and torsional mechanical interlock and adhesive bonded connection or coupling between the composite tool shank 16 and the metal tip 14. As may be seen from drawing FIGS. 1 and 3, the fiber reinforced, composite shank 16 increases in diameter towards the handle, with the taper of the conical hollow composite shank 16 being readily accomplished in the braiding or winding operation, the result of which is to increase the strength and torsional rigidity of the composite tool shank 16 without imposing a significant weight penalty on this major element of the hand tool 10. The torsional rigidity of the tool is important as the users are likely to resist using a tool that has an appreciable windup during torquing. The composite shank is thus arranged to provide the same effective stiffness and therefore feel as a much heavier metal tool such as a conventional screwdriver in which only the handle is formed of non-metal such as molded plastic and where the screwdriver shank is a relatively heavy metal rod having an end remote from the screwdriver tip embedded in the molded plastic handle.

The braided or wound filaments F of the composite tool shank 16 are typically high strength, high dielectric fibers, for example E-fiberglass (E-glass), S-2 fiberglass (S-glass), or ceramic fiber. Depending upon the special requirements of the tool 10, the filaments F may be braided in a conventional biaxial construction, a conventional triaxial construction, or of an asymmetrical construction. Alternatively, the fibers F may be wound onto the mandrel 12. Where stiffness and strength considerations are paramount, the filaments or fibers F may be wound or braided in a reduced undulation biaxial or triaxial construction. The preferably braided composite shank 16 will be completed by the introduction and curing to a rigid state of a rigidizing matrix material. The matrix material illustrated is a resin R. Generally such matrix material preferably has the following characteristics: a structurally useful modulus of elasticity of at least 350,000 psi, low moisture absorption, adequate outdoor weathering resistance, and most importantly, a high dielectric strength and arc track resistance.

Examples of applicable matrix materials include epoxies or resins such as Union Carbide ERL-4221 Cycloaliphatic, DOW Derakane 8084, Advanced Polymer Sciences' Siloxirane and high performance thermoplastics such as PET Polyester, Polysulfone, NYLON®, etc. It will be evident that there may be unusual applications for which a glass or ceramic matrix may be beneficial and substituted for those matrix materials above. The invention is broadly intended to include ceramic or glass matrix composites.

The composite tool shank 16 may be formed by any of the following well known methods in the art of manufacturing composite materials: resin transfer molding, wet braiding, wet filament winding, braiding or winding of commingled reinforcing fiber with thermoplastic fiber followed by compression molding. In the case of glass and ceramic matrix composites, the composite may be manufactured by such common methods as sol-gel conversion and powder slurry impregnation followed by compression molding.

Referring next to FIGS. 1 and 3, the injection molded replaceable dielectric cover 18 allows the user to periodically renew the exterior surface of the tool by replacing a marred or dirty injection molded cover 18 by a new cover. The cover is typically injection molded of a tough, high dielectric thermoplastic material such as a ultra high molecular weight polyethylene, NYLON®, vinyl based polymer, etc. In the embodiment of FIGS. 1–3, the braided or wound composite tool shank 16 includes a circumferential retention lip as at 62 defined by radially inwardly and forwardly directed bevelled surface 62A, which merges with the oblique front surface 30A of conical flange 30 and which defines with circumferential groove bottom surface 29 and shoulder 28 an annular cavity sized to the thickness of leading edge bead 48 of the replaceable dielectric cover 18. The bead 48 enables retention of the replaceable cover when positioned on and over the metal tip 14. Bead 48 rides over the flared, curved surface 14D of the working end 14A of the metal tip, with the annular bead 48 snapping into the circumferential groove 26, FIG. 3. Further, the balance of the cover 18, rearwardly of bead 48, is of uniform thickness, in the form of a hollow conical portion tapered to match the profile of the composite shank 16 outer surface 24. Upon installation, the replaceable cover 18 is stretched slightly in its final position in contact with and embracing the composite tool shank 16.

As seen in FIG. 3, the replaceable dielectric cover 18 includes an integral tear strip type structure exemplified by the pull tab 64 which extends axially beyond the leading end of the injection molded replaceable cover 18, FIG. 1. When pulled in a longitudinal direction away from the end bearing the tab or tear strip 64, the tab 64 will split the cover permitting its immediate removal and permitting replacement by a new, clean and unmarred dielectric cover 18. The replaceable dielectric cover 18 as shown in the cutaway portion of FIG. 1 extends nearly the complete length of the composite tool shank 16 but stops short of handle 20. The composite tool shank 16 includes a conical terminal portion 16C which conforms to a bevelled rear end 12B of the mandrel 12 to further ensure axial retention of the metal tip 14 by the composite tool shank molded about the tip shank 14B, and about the front end 12A of the mandrel, which is received internally of the hollow tip shank 14B.

The injection molded thermoplastic handle 20 is of elongated cylindrical form having a shallow groove 20A within the outer periphery of the same, near a front end 20B of the handle and being molded with an appropriate axial bore 66 sized to receive the end 16C of the composite tool shank 16 with the bore matching the shape of the shank 16. A press fit joint may be effected between the injection molded thermoplastic handle 20 and the composite tool shank 16. Alternatively a layer 60 of adhesive may be interposed within bore 66 and which bonds to the exterior surface of the composite tool shank 16 in that area to effect a strong mechanical coupling. The injection molded thermoplastic handle 20 should be fixedly connected to the composite tool shank 16 without interference to the replacement of the dielectric cover 18 or access to pull tab 64. The use of replaceable dielectric cover 18 thus allows the user to immediately return the tool shank 16 to a virgin surface condition and to provide a renewable means of mechanical protection from common tool abuse including impact, abrasion, cutting action, etc. Further, the injection molded replaceable shank cover 18 facilitates manufacturing of the tool 10 by acting as a female mold surface providing high electric resistance, while preventing damage to the relatively brittle composite tool shank 16. The presence of the hollow countersink 39 within the metal tool tip shank 14B allow the tip 14 to be wedged onto an injection molded core or mandrel 12 to facilitate the manufacture of the composite tool shank aspect of the tool 10 while providing a gradual transition in stiffness at the metal tip composite shank joint. The conical bore 38 angle $\alpha$ of the countersink may range from 2° to 15° but more preferably, should be on the order of 6°. Additionally, by employing a composite tool shank taper angle $\phi$ of approximately 1.5°, there is an increase in torsional and bending stiffness provided to the composite tool shank without making the tool excessively bulky. The braided tool shank taper angle $\phi$ may range between 0° to 15°. By employing braided or wound filaments or fibers to produce the structural composite tool shank 16, the torsional strength and stiffness is advantageously achieved in a fully electrically insulating tool shank formed, for instance, of an S-2 fiberglass/epoxy resin composite structure. From the embodiment of FIGS. 1–4, it may be appreciated that the lighter hand tool 10 reduces fatigue and minimizes strain which often leads to muscular or skeletal injury to the workmen in the workplace. This is especially true for workers who must climb with their tools or work in difficult positions. The self-insulating tool 10 reduces the incidence of burns due to arcing between live contacts and electrical shock, the self-insulating tool 10 prevents the possibility of workers making their own improvised insulated tools or ignoring safety procedures using standard tools devoid of electrical insulation for expediency. The invention constitutes a versatile tool tip and tool holder structural combination needed to meet the needs of an increasing diverse work force. The tool is not only versatile and highly effectively electrically insulated to remove the user from contact with the metallic metal tool tip, but a weight saving for a hand tool which may be only 30 to 70% that of existing standard and insulated hand tools. To meet I.E.C. 900 standards, the metal tip 14 is required to have a tip shank 14B approximately twice the length of the working end 14A. For instance, the tip shank may be approximately 30 mm in minimum length with that of the working end 14A, approximately a maximum of 15 mm. The improved tool 10 provides approximately equal functional performance to conventional tools in terms of torque application and stiffness by use of an integral double collar (not shown) near the grip. There is effected an increase in the electrical path, and the improved tool permits snap-in holding of a metal tool tip to the composite tool shank. Importantly, the fiber reinforced cured resin composite tool shank may be created by composite braiding including the wet braiding technique and apparatus, which is the subject matter of the common corporate assignee's U.S. Pat. No. 4,494,436 and may employ biaxial or triaxial symmetric braiding, or asymmetric braiding as set forth in the common corporate assignee's U.S. application Ser. No. 07/932,732, filed Aug. 25, 1992, entitled "ASYMMETRIC BRAIDING OF IMPROVED FIBER REINFORCED PRODUCTS." The tool as designed is believed to meet or exceed I.E.C. Standard 900 "Hand Tools for Live Working up to 1,000 V AC and 1,500 V DC." Further, the tool may be formed of advanced thermoplastics (e.g. AVTEL, TORLON, CELAZOLE) to meet specific tool performance requirements. The applicants' design compares quite readily with that of a conventional 5/16 inch by 6 inch flat blade screwdriver as follows:

TABLE 1

COMPARISON OF 5/16" × 6" FLAT BLADE SCREWDRIVERS

| | Stanley Professional | Unico | Cohardite (Insulated Tools Co.) | Applicant's Claimed Design |
|---|---|---|---|---|
| Retail Cost | $4.49 | ? | $25.00 | $9.00* |
| Insulated? | N | N | Y | N/A |
| Self Insulating | N | N | N | Y |
| Weight | 146.6 g | 145.5 g | 208 g | 65 g |

TABLE 1-continued

COMPARISON OF 5/16" × 6" FLAT BLADE SCREWDRIVERS

| | Stanley Professional | Unico | Cohardite (Insulated Tools Co.) | Applicant's Claimed Design |
|---|---|---|---|---|
| Torque Cap., In-Lb. (Est'd) | 160 | 160 | ? | 160 |
| Torsional ('GJ') lb-in$^2$ | 10,840 | 10,550 | ? | 10,505 |

Figure 5:
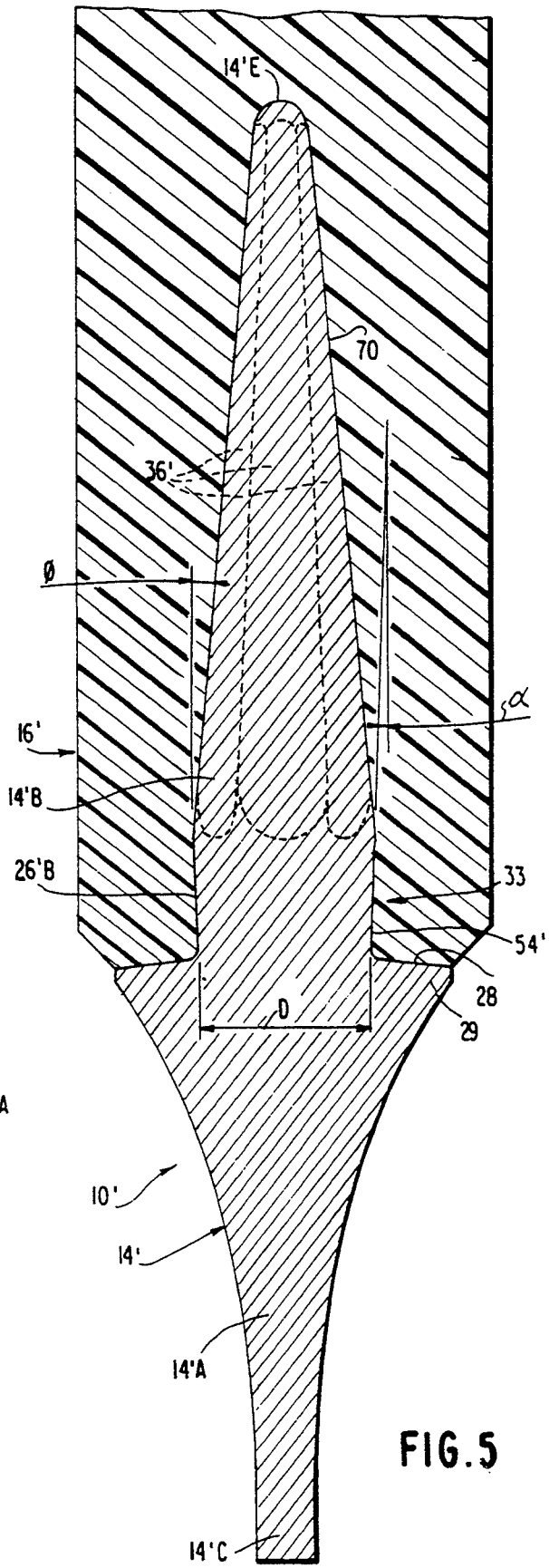
FIG. 5 is an enlarged sectional view of a modified screwdriver of FIG. 1 forming a second embodiment of the invention in which a rigid rod polymer tool shank is molded over a metal tip shank similar to that of the embodiment of FIGS. 1–4.

FIG. 5 shows an enlarged longitudinal sectional view of a second embodiment of the invention, directed to lightweight, self insulating tool 10'. Like elements bear like numerals to those of the first embodiment. A molded tool shank 16' is molded onto a tool tip 14', about a tip shank 14'B using the tool tip holding feature to that of the first embodiment of FIGS. 1–4. The tool holder feature of the embodiment of FIG. 5 acts in combination with the metal tip retention means as illustrated best in FIG. 3 of the first embodiment. While significant portions of the structural content of the first embodiment, FIGS. 1–4 are not illustrated in the longitudinal sectional view of FIG. 5, FIG. 5 does illustrate in its entirety the retention feature for retention of a metal tip indicated generally at 14' by the molded plastic tool shank indicated generally at 16'. In this embodiment, the tool shank 16' is constituted by an injection molded or compression molded rigid rod polymer. The alternative material makeup of the composite tool shank 16' offers a lower cost tool 10' which again takes the form of a screwdriver and which does not require the high strength or stiffness of the tool 10 of the first embodiment. In the illustrated embodiment of FIG. 5, the metal tip 14' is comprised of a working end 14'A and the metal tip shank 14'B. The working end 14'A terminates in a screwdriver flat blade 14'C, and the tool 10' is a screwdriver similar to the first embodiment.

The exterior surface of the working end 14'A is flared outwardly and rearwardly and terminates in a radial shoulder 28 defined by a annular recess or axial groove 33. The recess 33 is formed by a reduced diameter, short length peripheral surface extending rearwardly from the radial shoulder 28 at 54', which is slightly conical and flares radially outwardly in a direction away from the flange 28 at an approximately 2° re-entrant angle $\alpha$ to positively retain the metal tip engaged in the molded, rigid rod polymer tool shank 16'. Rearwardly of the peripheral surface portion 54' defining recess 33 of the tip shank 14'B, the balance of the metal tip shank 14'B tapers rapidly inwardly in the direction of a rear terminal end 14'E of the metal tip 14'. Additionally, the periphery 54 of that portion of the tip shank 14'B is provided with an exterior surface polygon profile which in cross section is hexagonal in contrast to the pentagonal shape of the outer periphery of the tip shank 14B in the first embodiment. The rigid rod polymer composite shank 16' is molded thereabout. As indicated at arrow $\phi$, the periphery 70 of the rear terminal portion of the tip shank 14'B tapers inwardly in a direction away from the outwardly and rearwardly flared surface portion 54 at an angle $\phi$ of approximately 5° to provide a gradual load transfer from the metal tip shank 14'B into the molded rigid rod polymer tool shank 16'. The hexagonal facets are illustrated in dotted lines at 36'. The neck length L of peripheral portions 54 between the radial shoulder 28' and the rearwardly and inwardly tapered terminal portion terminal of the tip shank 14'B may be expanded to move the end AE of the metal tip 14' further into the molded shank 16' for improved torsional stiffness. Further, the neck diameter D is sized to provide adequate torsional strength in the metal tip 14', as well as providing sufficient wall thickness of the molded shank 16' to resist torsion and hoop stresses created by the facets 36' of the metal tip shank 14'B.

Alternatively, if desired, the tool 10 of FIGS. 1–4 may incorporate a groove between two radial flanges, axially spaced with the metal tool tip, which groove snaps into the tubular leading end of the composite tool shank. That groove may be of square or hexagonal profile, enabling the user to facilitate torquing by applying a wrench to the metal tool tip 14. Thus, a composite tool shank 16 functions as a tool holder consisting of a small socket into which the metal tip 14 may be inserted and the tool quickly snapped into retention prongs with a quick inward motion. Conversely, with minimal force, a user can grasp the handle such as a handle 20 (not shown) of the FIG. 1 embodiment, rotate the tool tip to unsnap the tool tip from the retention snap and pull the tool tip upwardly and out of the tip holding socket defined by the component tool shank or its equivalent. As may be appreciated, a tool holder formed principally of a composite tool shank could be strapped by elastic or VELCRO bands around the tool user's wrists, arms, thighs, etc., wherever it would be most convenient to the user. Tool belts could also be created with an array of tool tip holding sockets to minimize the fumbling around in the tool pouch, which frequently occurs to the distraction and aggravation of workers.

The lightweight nature of the composite tool 10, or rigid rod polymer 10' is important to the practicality of this type of tool holding system as the force of the retention clamp, no matter what its form, cannot be so great as to provide difficulty to the worker in installing and removing the tool tip from the holder as defined by the composite tool shank, yet must be sufficient to positively retain the tool tip as the worker moves up and down a ladder, etc. In addition to the single flange as shown in FIG. 3, the tool tip 14 may include a further radial flange which extends some distance outwardly of tool tip shank peripheral surface at recess 33 and which is spaced axially from the shoulder 28 so as to constitute double flanges for ensuring retention of a tool tip by the composite tool shank acting as a tool holder. For a modified tool 10' not using the tool holding system as shown in drawing FIG. 5, and described above, such double flange tool holding system applied to that embodiment provides additional means for achieving safety against electrical shock as it will shield the worker's hand from such hazard, minimizing the likelihood of the worker's thumb and forefinger, extending outwardly from the composite tool shank 16' and wrist contact with electrically energized components in the workplace.

It should be evident from the above description with respect to the two illustrated embodiments that a wide variety of self insulated hand tools can be effected by this invention, while offering the same advantages of light weight and self insulating structure, while adapting the invention as described to tools such as ratchet handles, wrenches, ratchet extensions, etc.

What is claimed is:

1. A lightweight self-insulating hand tool comprising: a tool tip having a working end and an integral tip shank, an electrically insulative material tool shank molded about said tip shank and extending from said tip shank away from the tool tip working end, a molded-in mechanical interlock coupling between said tool tip and said tool shank resisting axial tensile and compression stress and torsion stress separation of said tool tip from said tool shank, and an electrically insulative handle carried by said tool shank remote from said tool tip.

2. The hand tool as claimed in claim 1, further comprising a replaceable elastomeric cover mounted to said tool shank and extending from said tool tip to said handle.

3. The hand tool as claimed in claim 2, wherein said handle comprises a molded plastic member.

4. The hand tool as claimed in claim 3, wherein said tool shank is a composite shank of reinforcing filaments and a set matrix.

5. The hand tool as claimed in claim 4, wherein said reinforcing filaments are braided onto the tip shank, and said tool tip includes one of a radial projection and a radial groove having said filaments braided thereover, and forming with said set matrix, said molded in mechanical coupling.

6. The hand tool as claimed in claim 1, wherein said tool tip is formed of one material of the group consisting of chrome-vanadium alloy steel; 17-4 PH Stainless Steel; a Berylium-Copper alloy; and Titanium-6AL-4V.

7. The hand tool as claimed in claim 4, wherein said reinforcing filaments comprise high strength, high dielectric fibers of the group consisting of E-fiberglass, S-2 fiberglass and ceramic fiber.

8. The hand tool as claimed in claim 4, wherein said composite shank is of reduced undulation biaxial or triaxial asymmetric construction.

9. The hand tool as claimed in claim 4, wherein said matrix has a modulus of elasticity of at least 350,000 psi, has low moisture absorption, high outdoor weathering resistance and high arc track resistance.

10. The hand tool as claimed in claim 4, wherein said matrix is one material of the group consisting of epoxy, thermoplastic resin, thermosetting resin.

11. The hand tool as claimed in claim 4, wherein said matrix is one material of the group consisting of Union Carbide ERL-4221 Cycloaliphatic, DOW Derakane 8084, Advanced Polymer Sciences' Siloxirane, PET Polyester, PET Thermoplastic, Polyester Thermoplastic, Polysulfone Thermoplastic and NYLON®.

12. The hand tool as claimed in claim 4, further comprising an injection molded electrical insulation core in abutment with the tip shank and extending rearwardly therefrom in a direction away from the tool tip working end, and wherein said composite tool shank has electrical insulation filaments braided about said mandrel and said tip shank.

13. The hand tool as claimed in claim 12, wherein said to shank is hollow and includes a countersunk internal region, and said injection molded core has a peripheral portion at the end in contact with the tip shank matching that of the countersunk internal region such that the braided filaments maintain axial engagement between the mandrel and said tool tip.

14. The hand tool as claimed in claim 4, wherein said mechanical interlock coupling comprises a positive torsional mechanical interlock effected by the engagement of the filaments and a plurality of flat facets formed on the outer periphery of the tip shank, thereby ensuring transmittal of high torque forces to the metal tool tip from the handle of the hand tool.

15. The hand tool as claimed in claim 13, wherein said hollow to shank internal region is defined by a bore within the end of the integral tip shank remote from the working end, and which bore terminates in the vicinity of a junction between the working end and the tip shank of said tool tip.

16. The hand tool as claimed in claim 15, wherein the bore within said metal tip is conical, matching the end of the injection molded mandrel received within said tip shank internal region.

17. The hand tool as claimed in claim 4, wherein said mechanical interlock coupling comprises a circumferential groove within the periphery of said tip shank of conical shape extending rearwardly and outwardly in the direction of the mandrel at a small retention angle $\alpha$ to interlock the metal tip to said composite shank, thereby resisting axial tensile and compression forces tending to separate the tool tip from the tool shank.

18. The hand tool as claimed in claim 17, wherein said retention angle is approximately 2°.

19. The hand tool as claimed in claim 15, wherein the countersink conical bore within said tip shank is at an angle ranging from 2° to 15° relative to the longitudinal axis of the hand tool facilitating wedging of the injection molded core into the hollow tip shank, thereby providing a gradual transition in stiffness at the tip-composite tool shank joint defined thereby.

20. The hand tool as claimed in claim 1, wherein said working end terminates remote from the integral tip shank in a flat, relatively thin screwdriver blade.

21. The hand tool as claimed in claim 2, further comprising a circumferential groove within the periphery of the tool tip working end at the junction of the working end and the tip shank, and wherein said replaceable elastomeric cover includes a resilient bead at a front end thereof and having an inside diameter such that the bead expands resiliently over the working end of the tool tip and snaps into the circumferential groove to lock the cover onto the tool tip at said bead, and wherein said replaceable elastomeric cover has an inside diameter matching that of the outside diameter of said molded on tool shank, whereby the replaceable elastomeric cover grips the outer periphery of the tool shank over the length of the replaceable elastomeric cover rearwardly of said bead.

22. The hand tool as claimed in claim 14, wherein the cross-sectional configuration of said tip shank is polygonal and defined by said multiple flat facets.

23. The hand tool as claimed in claim 22, wherein said tip shank is pentagonal.

24. The hand tool as claimed in claim 4, wherein said replaceable elastomer cover has an internal diameter which is in excess of the diameter of a recessed portion of said tip shank and functions as a mold for the matrix material within which said filaments are embedded during the fabrication of the composite shank.

25. The hand tool as claimed in claim 4, wherein said composite tool shank tapers rearwardly and outwardly at a tool shank taper angle of approximately 1.5°, thereby increasing the torsional and bending stiffness of the composite tool shank, and wherein the replaceable elastomeric cover is of tubular form with an interior surface which tapers rearwardly and radially outwardly at an angle of approximately 1.5° matching that of the tool shank taper.

26. The hand tool as claimed in claim 25, wherein said tubular replaceable elastomeric cover includes a tab projecting longitudinally beyond the end of the cover proximate to said handle, thereby creating a tear strip longitudinally through the replaceable elastomeric cover, permitting the elastomeric cover to be split longitudinally for removal of the elastomeric cover and replacement of the same.

27. The hand tool as claimed in claim 1, wherein said tool shank comprises a rigid rod polymer having a front end molded about the tool tip shank.

* * * * *